US008044708B2

(12) United States Patent
Kume

(10) Patent No.: US 8,044,708 B2
(45) Date of Patent: Oct. 25, 2011

(54) REFERENCE VOLTAGE GENERATOR

(75) Inventor: Tomohiro Kume, Osaka (JP)

(73) Assignee: Panasonic Corporation, Osaka (JP)

( * ) Notice: Subject to any disclaimer, the term of this patent is extended or adjusted under 35 U.S.C. 154(b) by 46 days.

(21) Appl. No.: 12/643,277

(22) Filed: Dec. 21, 2009

(65) Prior Publication Data

US 2010/0156520 A1 Jun. 24, 2010

(30) Foreign Application Priority Data

Dec. 22, 2008 (JP) ..... 2008-326442

(51) Int. Cl.
*G05F 1/10* (2006.01)

(52) U.S. Cl. ..... 327/538; 327/143

(58) Field of Classification Search ..... 327/143, 327/535, 538, 540, 541
See application file for complete search history.

(56) References Cited

U.S. PATENT DOCUMENTS 5,859,563 A * 1/1999 Yung et al. ..... 327/538
5,886,565 A * 3/1999 Yasui et al. ..... 327/530
5,889,392 A 3/1999 Moore et al.
5,892,381 A 4/1999 Koifman et al.
5,959,439 A 9/1999 Shenai et al.
7,362,081 B1 4/2008 Huang

FOREIGN PATENT DOCUMENTS

JP 6-301429 A 10/1994
JP 8-272461 A 10/1996
JP 2002-023870 A 1/2002
JP 2005-346522 A 12/2005

* cited by examiner

*Primary Examiner* — Jeffrey Zweizig
(74) *Attorney, Agent, or Firm* — Hamre, Schumann, Mueller & Larson, P.C.

(57) ABSTRACT

A reference voltage generator includes: a reference voltage source 1 that generates a direct-current voltage that is used as a reference; a low-pass filter 2 that is connected to an output node of the reference voltage source; a first voltage buffer circuit 10 with an input terminal to which the output node of the reference voltage source is connected and an output terminal to which an output node of the low-pass filter is connected, which has a voltage gain of one time; and a hysteresis comparator 11 with one input terminal to which the output node of the reference voltage source is connected and an other input terminal to which the output node of the low-pass filter is connected. At start-up, during a time period in which a voltage difference between an output of the reference voltage source and an output of the low-pass filter exceeds a predetermined value, an output impedance of the first voltage buffer circuit is controlled based on an output signal of the hysteresis comparator. At start-up, the low-pass filter that reduces noise is charged with a low impedance rapidly, and thus an output voltage can be stabilized rapidly.

6 Claims, 5 Drawing Sheets

REFERENCE VOLTAGE GENERATOR

BACKGROUND OF THE INVENTION

1. Field of the Invention

The present invention relates to a reference voltage generator, and particularly to an improved configuration in which a capacitor of a low-pass filter for reducing the noise of a reference voltage source is charged rapidly so that an output voltage is stabilized rapidly.

2. Description of Related Art

A configuration in which a low-pass filter is provided additionally downstream of a reference voltage source in order to reduce the noise of the reference voltage source is disclosed in, for example, JP 8(1996)-272461 A (first conventional example). FIG. 7 shows a circuit according to this first conventional example. In the configuration shown in FIG. 7, a low-pass filter 2 composed of a resistor R and a capacitor C is connected to a point A to which a voltage of a reference voltage source 1 is outputted so as to reduce noise in a voltage outputted to a point B. Hereinafter, a resistance value of the resister R is represented by "R" and a capacitance value of the capacitor C is represented by "C". In a general configuration, the voltage at the point B is amplified by a non-inverting amplifier using an operational amplifier 3 and outputted as an output voltage Vout from an output terminal 5 by an output transistor 4.

In this configuration, generally, a time constant RC of the low-pass filter 2 is larger than a time constant of, for example, a transistor constituting the reference voltage source 1 or the operational amplifier 3. Because of this, after power-on, a considerable time is required for the output voltage Vout to rise logarithmically with the time constant RC until it is stabilized to a steady state. FIG. 9 shows waveforms of the output voltage Vout until they are stabilized. The horizontal axis indicates a time and the vertical axis indicates a value of the output voltage Vout. It can be understood that in the case of an output waveform P1 of the first conventional example, a considerable amount of time is required until the output voltage Vout is stabilized.

As a solution to this problem, a configuration in which a low-pass filter is charged rapidly while a voltage is monitored is disclosed in, for example, JP 2002-23870 A (second conventional example). FIG. 8 shows a circuit according to this second conventional example. In the configuration shown in FIG. 8, a point B that is an output point of a low-pass filter composed of a resistor R and a capacitor C is connected to one of input terminals of a hysteresis comparator 6. The other of the input terminals of the hysteresis comparator 6 is connected to a point A to which a voltage of a reference voltage source 1 is outputted. The point B is connected to a power source Vdd via a switch SW1, and a terminal of the capacitor C on the point B side is connected to a terminal thereof on the ground side via a switch SW2.

This circuit operates as follows. First, immediately after power-on, a voltage outputted from the reference voltage source 1 to the point A rises immediately to a constant voltage. On the other hand, due to the capacitor C of the low-pass filter, a voltage at the point B rises slowly and logarithmically with a time constant RC. At this time, a comparison is made between the voltage at the point A and the voltage at the point B by the hysteresis comparator 6, and if a voltage difference therebetween is not less than a constant voltage, the point B and the power source Vdd are short-circuited by means of the switch SW1. This causes the capacitor C of the low-pass filter connected to the point B to be charged rapidly.

Consequently, as can be seen from an output waveform P2 of the second conventional example shown in FIG. 9, the output voltage Vout rises rapidly with a time constant having a value obtained by multiplying an equivalent resistance of the switch SW1 when short-circuited and the capacitance C. Compared with the resistance R of the low-pass filter, the equivalent resistance of the switch SW1 when short-circuited is extremely small, thereby reducing a stabilization time required until a steady state is achieved. The switch SW1 is opened at a point in time when a potential difference between the point A and the point B becomes less than the set voltage, after which the voltage at the point B is raised with the time constant RC of the low-pass filter and gradually approximates to the voltage at the point A.

The switch SW2 is used to cause a discharge of electric charges accumulated in the capacitor C at the time of the fall of the output voltage Vout. This allows the output voltage Vout to drop rapidly, thereby reducing a current consumption.

In addition to the above-described configurations, it is known that the time required until the output voltage Vout is stabilized is reduced by, a configuration disclosed in JP 2005-346522 A in which a capacitor is charged while an imbalance in an internal voltage of a reference voltage source is detected by a comparator, and a configuration disclosed in JP 6(1994)-301429 A in which a time constant of a low-pass filter is switched from a small value to a large value.

SUMMARY OF THE INVENTION

However, in the above-described second conventional example, when a voltage difference between the point A and the point B reaches a set value of the hysteresis comparator, rapid charging controlled by means of the switch is halted, and thus until a steady state voltage is reached, charging is performed with the time constant RC of the low-pass filter. Therefore, after the voltage difference has reached the set value, a further time is required until a steady state is reached.

The method of the second conventional example seemingly is advantageous in that, even when the time constant is not sufficiently small, the stabilization time can be reduced infinitely by setting the set value of the hysteresis comparator to be small. However, the fact is that, due to an offset voltage of the hysteresis comparator that hardly can be made to become 0 V, an inputted voltage difference is shifted to a value in the neighborhood of the set value.

Furthermore, even if the offset voltage can be made to be 0 V by calibration or correction, a switching off of the switch tends to be delayed due to the limited response of the hysteresis comparator, so that an excessive voltage is applied to the power source voltage side, leading to the occurrence of overshoot of the output voltage Vout.

Moreover, when the switch is formed of a semiconductor element such as a MOS or the like, due to a charge injection effect in which electric charges accumulated in a channel are discharged when turning off, an electric current flows, though for a short time, into the capacitor of the low-pass filter even after the switch has been switched off, so that a voltage becomes even higher. Whether the output voltage Vout is insufficient or excessive with respect to a steady state voltage, an operation of gradually approximating to the steady state voltage occurs with the time constant RC, resulting in a delay in the stabilization.

In battery-driven devices of recent years such as portable communication equipment, in order to achieve high output driving and long battery life at the same time, electric power is controlled finely. This imposes a requirement for a predetermined reference voltage to be generated immediately after power-on, which, however, has been difficult to be met sufficiently by a conventional method.

With the foregoing in mind, it is an object of the present invention to provide a reference voltage generator that is capable of charging a capacitor of a low-pass filter for reducing noise rapidly so that an output voltage can be stabilized rapidly.

In order to solve the above-described problems, a reference voltage generator of a first configuration according to the present invention includes: a reference voltage source that generates a direct-current voltage that is used as a reference; a low-pass filter that is connected to an output node of the reference voltage source; a first voltage buffer circuit with an input terminal to which the output node of the reference voltage source is connected and an output terminal to which an output node of the low-pass filter is connected, which has a voltage gain of one time; and a hysteresis comparator with one input terminal to which the output node of the reference voltage source is connected and the other input terminal to which the output node of the low-pass filter is connected. At start-up, during a time period in which a voltage difference between an output of the reference voltage source and an output of the low-pass filter exceeds a predetermined value, the first voltage buffer circuit is controlled to be in a low output impedance state based on an output signal of the hysteresis comparator.

A reference voltage generator of a second configuration according to the present invention includes: a reference voltage source that generates a direct-current voltage that is used as a reference; a low-pass filter that is connected to an output node of the reference voltage source; a voltage buffer circuit that subjects an output of the low-pass filter to impedance conversion to be outputted; a first switching element that is inserted between an output node of the low-pass filter and an input terminal of the voltage buffer circuit; a second switching element that is inserted between the output node of the low-pass filter and an output terminal of the voltage buffer circuit; a third switching element that is inserted between the output node of the reference voltage source and the input terminal of the voltage buffer circuit; and a hysteresis comparator with one input terminal to which an output of the reference voltage source is connected and another input terminal to which an output of the low-pass filter is connected. The first to third switching elements are controlled based on an output signal of the hysteresis comparator so as to be switched between a state where the first switching element is on and the second and third switching elements are off and a state where the first switching element is off and the second and third switching elements are on.

A reference voltage generator of a third configuration according to the present invention includes: a reference voltage source that generates a direct-current voltage that is used as a reference; a low-pass filter that is connected to an output node of the reference voltage source; and a first voltage buffer circuit with an input terminal to which the output node of the reference voltage source is connected and an output terminal to which an output node of the low-pass filter is connected, which has a voltage gain of one time. An output impedance of the first voltage buffer circuit is controlled based on an external signal.

According to each of the reference voltage generators of the above-described configurations, during a predetermined time period immediately after power-on, a capacitor C of the low-pass filter is charged rapidly by means of the first voltage buffer circuit or the switching elements. Thus, noise of the reference voltage source and disturbance can be reduced, and at power-up, a precise reference voltage can be attained in a short time.

DETAILED DESCRIPTION OF THE INVENTION

Based on the above-described configurations, the present invention can be embodied as follows.

That is, preferably, in the first configuration, an output impedance of the first voltage buffer circuit is controlled based on a signal obtained by delaying an output signal of the hysteresis comparator by a constant time period. Further, preferably, an output of the low-pass filter is outputted via a second voltage buffer.

In the second configuration, it is possible that, at start-up, during a time period in which a voltage difference between an output of the reference voltage source and an output of the low-pass filter exceeds a predetermined value, the first switching element is controlled to be off and the second and third switching elements are controlled to be on.

The disclosure of Japanese Patent Application No. 2008-326442 filed on Dec. 22, 2008, inducting the specification, drawings and claims, is incorporated herein by reference in its entirety.

Hereinafter, reference voltage generators in embodiments of the present invention will be described with reference to the appended drawings.

First Embodiment

Figure 1:
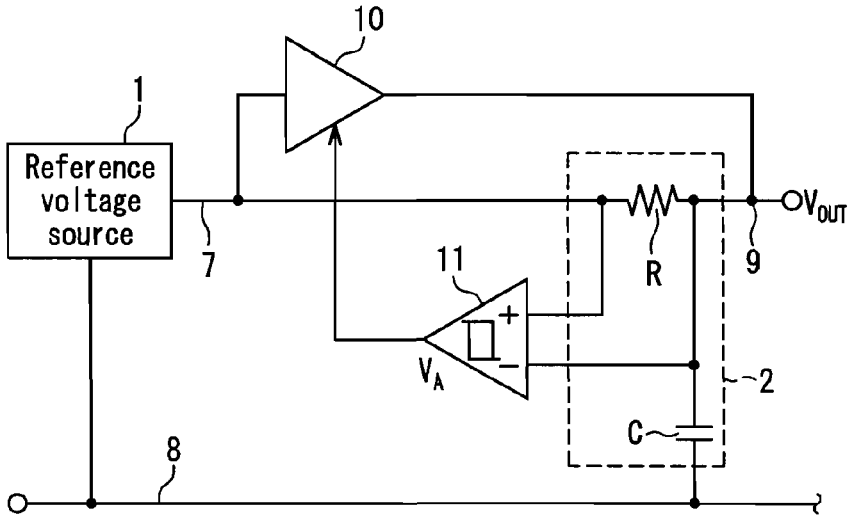
FIG. 1 is a circuit diagram of a reference voltage generator in a first embodiment of the present invention.

FIG. 1 is a circuit diagram showing a configuration of a reference voltage generator according to a first embodiment of the present invention. A low-pass filter 2 is connected to an output node 7 of a reference voltage source 1 that generates a direct-current voltage that is used as a reference. The low-pass filter 2 is a RC primary filter that in the simplest form is a low-pass filter composed of a resistor R and a capacitor C connected in series between the output node 7 and a ground terminal 8 of the reference voltage source 1. A connection point between the resistor R and the capacitor C is an output node 9 of the low-pass filter 2, at which a voltage obtained by smoothing an output voltage of the reference voltage source 1 is generated. This configuration reduces noise generated by the reference voltage source 1 and the influence of an external disturbance upon the reference voltage source 1.

An input terminal of a first voltage buffer circuit 10 further is connected to the output node 7 of the reference voltage source 1. An output terminal of the first voltage buffer circuit 10 is connected to the output node 9 of the low-pass filter 2. The first voltage buffer circuit 10 is switched between two states of its output impedance that are a high output impedance state and a low output impedance state. In the low output impedance state, a ratio between an output voltage and an input voltage, namely, a voltage gain is one time.

An output $V_A$ of a hysteresis comparator 11 is inputted to a control terminal of the first voltage buffer circuit 10. A voltage of the output node 7 that is an output of the reference voltage source 1 is inputted to one input terminal of the hysteresis comparator 11, and a voltage Vout of the output node 9 that is an output of the low-pass filter 2 is inputted to the other input terminal of the hysteresis comparator 11.

When in a steady state, the reference voltage source 1 generates a constant voltage, and as a typical example, a reference voltage source utilizing a band-gap voltage of a semiconductor element can be used. Further, low-pass filters may be selected from various types depending on their uses, and a configuration of a low-pass filter is not limited to that in this embodiment. As for a function thereof, it is sufficient that an AC component of a voltage is smoothed between an input of the low-pass filter 2 and the output node 9 to be outputted. Although, normally, a high output impedance circuit such as an error amplifier, a voltage buffer, a voltage comparator or the like further are connected to the output node 9, these have no relation to the basic aspects of the present invention and thus are not shown in the drawings.

The description is directed next to an operation of the reference voltage generator having the above-described configuration. When the first voltage buffer circuit 10 is in the high output impedance state, a voltage of the output node 7 of the reference voltage source 1 is smoothed and outputted to the output node 9 of the low-pass filter 2.

On the other hand, when the first voltage buffer circuit 10 is in the low output impedance state, a voltage of the output node 7 of the reference voltage source 1 is supplied to the output node 9 via the first voltage buffer circuit 10. An output impedance of the first voltage buffer circuit 10 is set to be sufficiently small with respect to an input impedance of the low-pass filter 2 when seen from the output node 9, and thus the capacitor C of the low-pass filter 2 is charged rapidly at this time. This allows a voltage of the output node 9 of the low-pass filter 2 to approximate rapidly to the voltage of the output node 7 of the reference voltage source 1.

Based on the respective voltages of the output node 7 of the reference voltage source 1 and the output node 9 of the low-pass filter 2, the output impedance of the first voltage buffer circuit 10 is controlled by the output $V_A$ of the hysteresis comparator 11 in the following manner.

An operation at power-on of the reference voltage source 1 is as follows. First, in a state where the power of the reference voltage source 1 is cut off or a bias current is cut off externally, a voltage of the output node 7 of the reference voltage source 1 has a value as an initial voltage between a steady state voltage and a potential of the ground terminal 8, which is normally equal to a potential of the ground terminal 8. From this state, the cutting off of the power of the reference voltage source 1 is cancelled. This operation is referred to as start-up of the reference voltage source. It can be assumed that the start-up immediately brings the output node 7 to a steady state in the case where the reference voltage source 1 has sufficiently fast response. On the other hand, since the low-pass filter 2 has a time constant determined by parameters and structures of its components, a voltage of the output node 9 cannot be raised immediately. This results in the occurrence of a voltage difference between the output node 9 and the output node 7.

Figure 9:
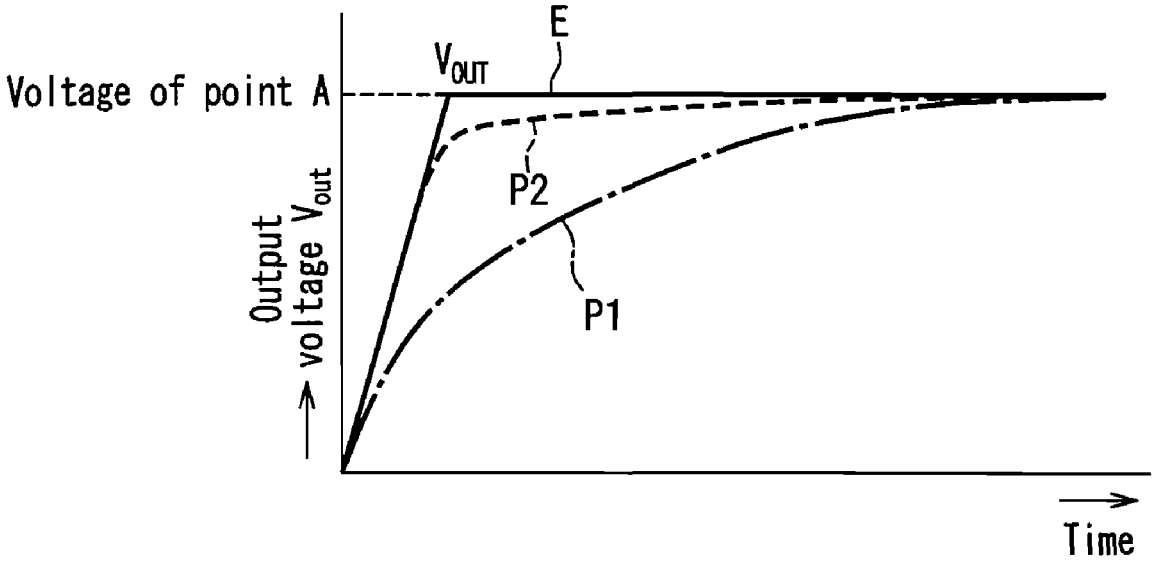
FIG. 9 is a graph showing voltage waveforms of the reference voltage generators in the embodiments of the present invention and in the conventional examples by comparison.

In the case where this voltage difference is larger than a first set value of the hysteresis comparator 11, the output impedance of the first voltage buffer circuit 10 is controlled so as to be in a low impedance state. This leads to an operation in which the low-pass filter 2 is charged with a low impedance with a target value set to a steady state voltage of the output node 7. Consequently, as shown by an output waveform E in FIG. 9, the voltage of the output node 9 rises rapidly.

When the voltage difference between the output node 9 and the output node 7 reaches a second set value of the hysteresis comparator 11, the output impedance of the first voltage buffer circuit 10 is controlled so as to be in a high impedance state. This causes a charging current from an output of the first voltage buffer circuit 10 to the low-pass filter 2 to be cut off. From this point in time, the voltage of output node 9 of the low-pass filter 2 gradually approximates to a steady state voltage value of the output node 7 of the reference voltage source 1 with the time constant of the low-pass filter 2. The time constant of the low-pass filter 2 shown in FIG. 1, which is constituted of a RC primary filter, is a product of a resistance value of the resistor R and the capacitance C.

During either a time period in which the voltage of the output node 9 of the low-pass filter 2 gradually approximates to the steady state voltage value of the output node 7 of the reference voltage source 1 with the time constant of the low-pass filter 2, or a time period in which a steady state is achieved, the voltage difference between the output node 9 and the output node 7 is smaller than the second set value of the hysteresis comparator 11. Therefore, throughout these time periods, the output $V_A$ of the hysteresis comparator 11 has such a value as to maintain the output impedance of the first voltage buffer circuit 10 in the high impedance state. At this time, the low-pass filter 2 smoothes the voltage of the output node 7 of the reference voltage source 1 so that noise generated by the reference voltage source 1 and an influence of disturbance upon the reference voltage source 1 are reduced, and outputs it to the output node 9.

With the configuration according to this embodiment, the following can be achieved by setting the second set value of the hysteresis comparator 11 to be sufficiently small. That is, despite the problems of an offset voltage and a delay in response of the hysteresis comparator 11 or a delay in response of the first voltage buffer circuit 10, unlike the conventional examples, excessive voltage application to a power source voltage side can be suppressed sufficiently, thereby allowing a steady state to be reached rapidly.

In some cases, when the voltage of the output node 9 of the low-pass filter 2 crosses the second set value of the hysteresis comparator 11, due to noise generated by the first voltage buffer circuit 10 or disturbance to the first voltage buffer circuit 10, chattering of the voltage of the output node 9 occurs, leading to an unstable operation of the first voltage buffer circuit 10. In order to prevent this and avoid the chattering, the first set value and the second set value of the hysteresis comparator 11 are set so that the former is sufficiently larger than the latter. However, in the case where the response of the first voltage buffer circuit 10 is sufficiently slower than a cycle of the occurrence of chattering and in the case where noise and disturbance are in such sufficiently low levels that chattering does not occur, the first set value and the second set value of the hysteresis comparator 11 can be set to be equal to each other, and thus a comparator without a hysteresis characteristic may be used in place of the hysteresis comparator 11.

Second Embodiment

Figure 2:
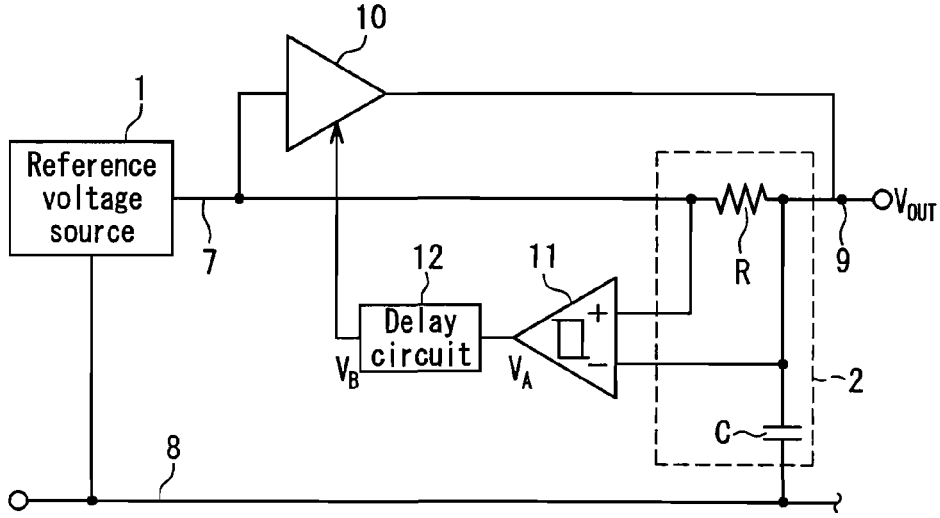
FIG. 2 is a circuit diagram of a reference voltage generator in a second embodiment of the present invention.

FIG. 2 is a configuration diagram of a reference voltage generator according to a second embodiment of the present invention. This reference voltage generator has a revised configuration of the reference voltage generator according to the first embodiment shown in FIG. 1, in which the output $V_A$ of the hysteresis comparator 11 is inputted to the first voltage buffer circuit 10 via a delay circuit 12. Based on a control signal $V_B$ delayed by a predetermined time period by the delay circuit 12, a first voltage buffer circuit 10 is controlled.

In the first embodiment, a time required from the time when the output impedance of the first voltage buffer circuit 10 is switched to the high impedance state until the time when the voltage of the output node 9 reaches the steady state is determined by the time constant of the low-pass filter 2. The smaller the second set value of the hysteresis comparator 11, the more the time required for the steady state to be reached is reduced. However, when the second set value is set to be smaller than an offset voltage value of the hysteresis comparator 11, the hysteresis comparator 11 is not switched even when the voltage of the output node 9 reaches a steady state value, and maintains the output impedance of the first voltage buffer circuit 10 in the low impedance state. This causes a voltage of the reference voltage source 1 to be outputted to the output node 9 in a state combined with noise and disturbance to the first voltage buffer circuit 10.

In contrast to this, in the second embodiment, with the delay circuit 12 inserted, an input of the control signal $V_B$ to the first voltage buffer circuit 10 is delayed by a predetermined time period from an output $V_A$ of a hysteresis comparator 11. Thus, even when a voltage value of an output node 9 reaches a second set value set to be a value not less than an offset voltage value of the hysteresis comparator 11, an output impedance of the first voltage buffer circuit 10 is maintained in a low impedance state until a lapse of the predetermined time period set by the delay circuit 12.

This delay time could be set to a time in the vicinity of or longer than a predicted time required for a steady state to be reached, which is shorter than a time required for a steady state to be reached in the case where the delay circuit 12 is not inserted. Normally, the delay time can be set to a time relatively shorter than the time required until the steady state is reached in the case where the delay circuit 12 is not inserted.

With the delay in response of the first voltage buffer circuit 10, even when overshoot of a voltage occurs, it is possible to avoid an influence thereof by setting the time period so as to take attenuation into account.

A configuration also may be adopted in which instead of using the delay circuit 12, for example, a capacitor is incorporated into the hysteresis comparator 11 so that the hysteresis comparator 11 itself has a delaying function.

Third Embodiment

Figure 3:
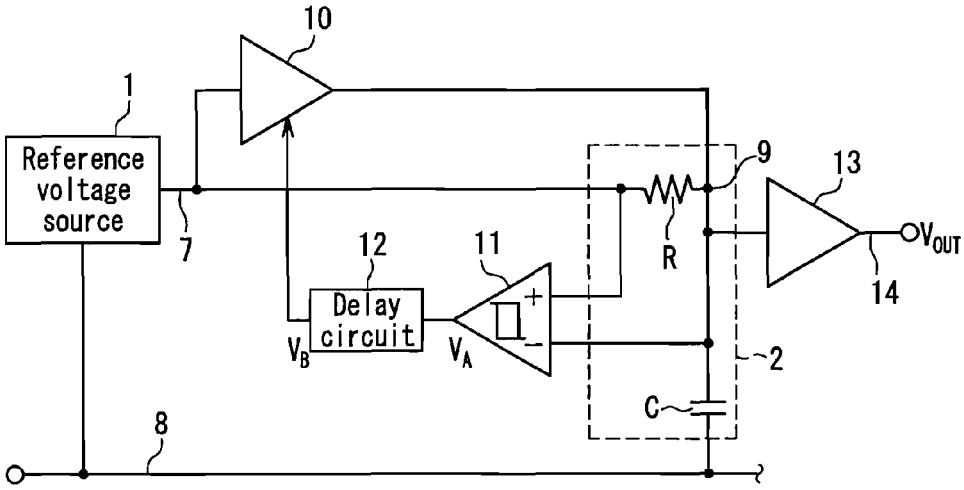
FIG. 3 is a circuit diagram of a reference voltage generator in a third embodiment of the present invention.

FIG. 3 is a configuration diagram of a reference voltage generator according to a third embodiment. This embodiment has a revised configuration of the reference voltage generator shown in FIG. 2, in which the output node 9 of a low-pass filter 2 is connected to an input terminal of a second voltage buffer circuit 13, and an output terminal 14 of the second voltage buffer circuit 13 is an output terminal of the reference voltage generator.

This configuration allows an output to be outputted to the output terminal 14 at a low output impedance. Most of loads are resistive or capacitive types and thus, in some cases, cannot be driven sufficiently with an output impedance of a low-pass filter 2. In such cases, impedance conversion is performed by the second voltage buffer circuit 13, thereby allowing the above-described problem to be solved.

In the case where conversion of an output voltage value is necessary, it is possible to use, in place of the second voltage buffer circuit 13, an inverting amplifier circuit or a non-inverting amplifier circuit in which an output voltage is divided resistively and then is fed back to an operational amplifier.

Fourth Embodiment

Figure 4:
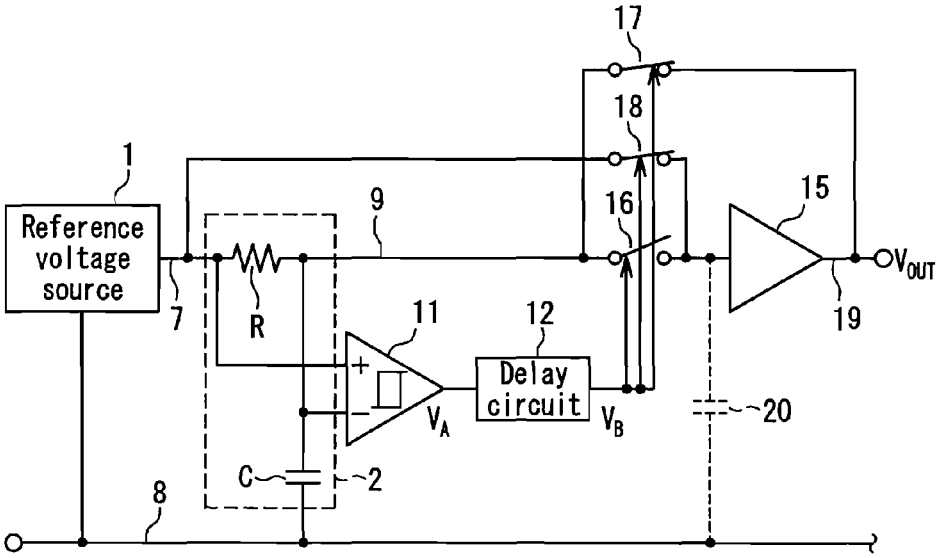
FIG. 4 is a circuit diagram of a reference voltage generator in a fourth embodiment of the present invention.

FIG. 4 is a configuration diagram of a reference voltage generator according to a fourth embodiment. This embodiment is characterized by a revised configuration of the reference voltage generator according to the third embodiment shown in FIG. 3, in which the second voltage buffer circuit 13 is configured also to have a function as a first voltage buffer circuit 10 (a voltage buffer circuit 15 in this embodiment).

For this purpose, first to third switching elements 16 to 18 for switching connection are provided. At the same time, instead of switching an output impedance of the first voltage buffer circuit 10 shown in FIG. 3, high-speed charging and interruption of a low-pass filter 2 are performed by conduction and interruption states of the first to third switching elements 16 to 18, respectively. The conduction and interruption states of first to third switching elements 16 to 18 are controlled based on an output signal of a delay circuit 12.

The low-pass filter 2 is connected to an output node 7 of a reference voltage source 1. At an output node 9 of the low-pass filter 2, a voltage obtained by smoothing a voltage of the output node 7 of the reference voltage source 1 is generated, thereby reducing noise generated by the reference voltage source 1 and an influence of disturbance upon the reference voltage source 1.

The output node 9 of the low-pass filter 2 is connected to an input terminal of the voltage buffer circuit 15 having a voltage gain of one time via the first switching element 16. The output node 9 further is connected to an output terminal 19 of the voltage buffer circuit 15 via the second switching element 17. Moreover, a connection point between the first switching element 16 and the voltage buffer circuit 15 is connected to the output node 7 of the reference voltage source 1 via the third switching element 18.

The following specifically explains an operation of the reference voltage generator shown in FIG. 4. By a hysteresis comparator 11 to which an output of the output node 7 of the reference voltage source 1 and an output of the output node 9 of the low-pass filter 2 are inputted, the first to third switching elements 16 to 18 are controlled through the delay circuit 12 in the following manner.

In FIG. 4, from a state where the power of the reference voltage source 1 is cut off or a state where a bias current supplied from exterior is cut off, the cutting off of the power of the reference voltage source 1 is cancelled so that the reference voltage source 1 starts up. As described with regard to the first embodiment, because of a time constant of the low-pass filter 2, the voltage of the output node 9 cannot be raised immediately, so that a voltage difference occurs between the output node 9 and the output node 7.

In the case where this voltage difference is larger than a first set value of the hysteresis comparator 11, as in the state shown in FIG. 4, the first switching element 16 is interrupted, while the second switching element 17 and the third switching element 18 are conductive. Thereby a voltage obtained by adding an offset voltage of the voltage buffer circuit 15 to the voltage of the output node 7 is outputted to the output terminal 19 of the voltage buffer circuit 15 with a low impedance. At the same time, based on the output voltage of the voltage buffer circuit 15, the low-pass filter 2 is charged with a low impedance to a steady state voltage of the output node 7 as a target value, and thus the voltage of the output node 9 rises rapidly.

When the voltage of the output node 9 is raised and thus a voltage difference between the output node 9 and the output node 7 reaches a second set value of the hysteresis comparator 11, the first switching element 16 is made conductive, while the second switching element 17 and the third switching element 18 are interrupted. This causes charging from the voltage buffer circuit 15 to the low-pass filter 2 to stop, so that the voltage of the output node 9 of the low-pass filter 2 gradually approximates to a steady state voltage value of the output node 7 of the reference voltage source 1 with the time constant of the low-pass filter 2. A voltage obtained by adding the offset voltage of the voltage buffer circuit 15 to the voltage of the output node 9 with noise reduced by the low-pass filter 2 is outputted to the output terminal 19 of the voltage buffer circuit 15 with a low impedance.

According to the above-described configuration, a function similar to that of the reference voltage generator of the third embodiment shown in FIG. 3 can be achieved using a reduced number of elements.

In order to prevent switching noise generated at the time of switching the first to third switching elements 16 to 18 from entering the input terminal of the voltage buffer circuit 15, a noise removing capacitor 20 may be connected between the input terminal of the voltage buffer circuit 15 and a ground terminal 8. Normally, it is sufficient for the noise removing capacitor 20 to have a small electrostatic capacitance, and a floating capacitance or an input capacitance of the input terminal of the voltage buffer circuit 15 may be used in place thereof. Further, in order to alleviate switching noise, when switching between the conduction and the interruption of the first to third switching elements 16 to 18, a short time period could be set in which all of the three switching elements are interrupted once.

Fifth Embodiment

Figure 5:
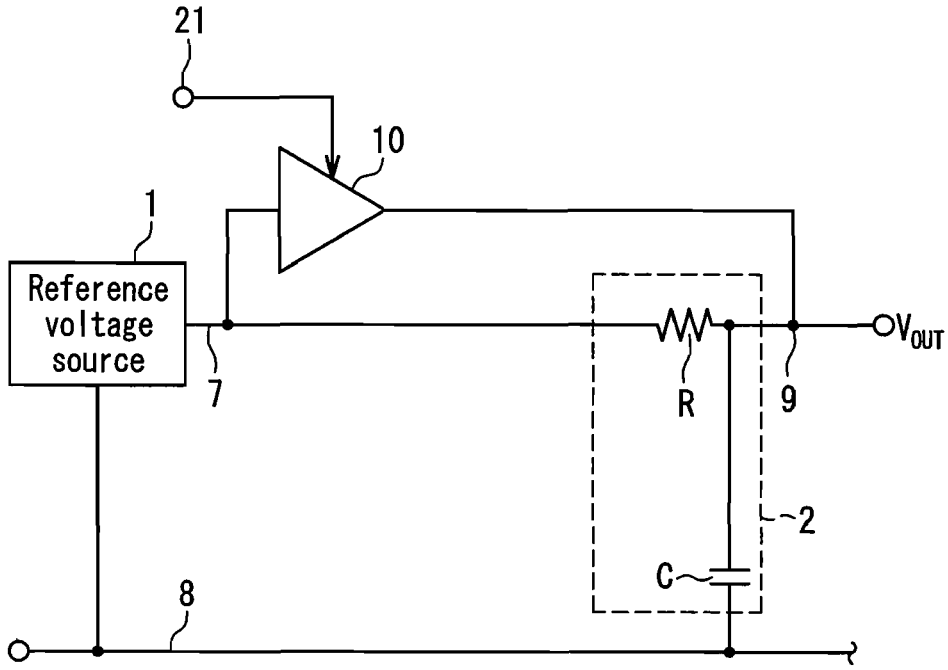
FIG. 5 is a circuit diagram of a reference voltage generator in a fifth embodiment of the present invention.

FIG. 5 is a configuration diagram of a reference voltage generator according to a fifth embodiment. This embodiment has a configuration such that in the reference voltage generator according to the first embodiment shown in FIG. 1, the state of the output impedance of the first voltage buffer circuit 10 is switched based on a signal from an external terminal 21 instead of a signal of the hysteresis comparator 11.

In FIG. 5, from start-up, an output impedance of a first voltage buffer circuit 10 is switched to a low impedance, and after a time period controlled by a signal supplied through the external terminal 21, the output impedance of the first voltage buffer circuit 10 is switched to a high impedance. The time period controlled based on the signal supplied through the external terminal 21 is set to a time in the vicinity of or longer than a predicted time required for a steady state to be reached. Although stabilization cannot be achieved in a time as short as in the above-described embodiments since a hysteresis comparator is not used, it is possible to switch the output impedance of the first voltage buffer circuit 10 freely.

Figure 6:
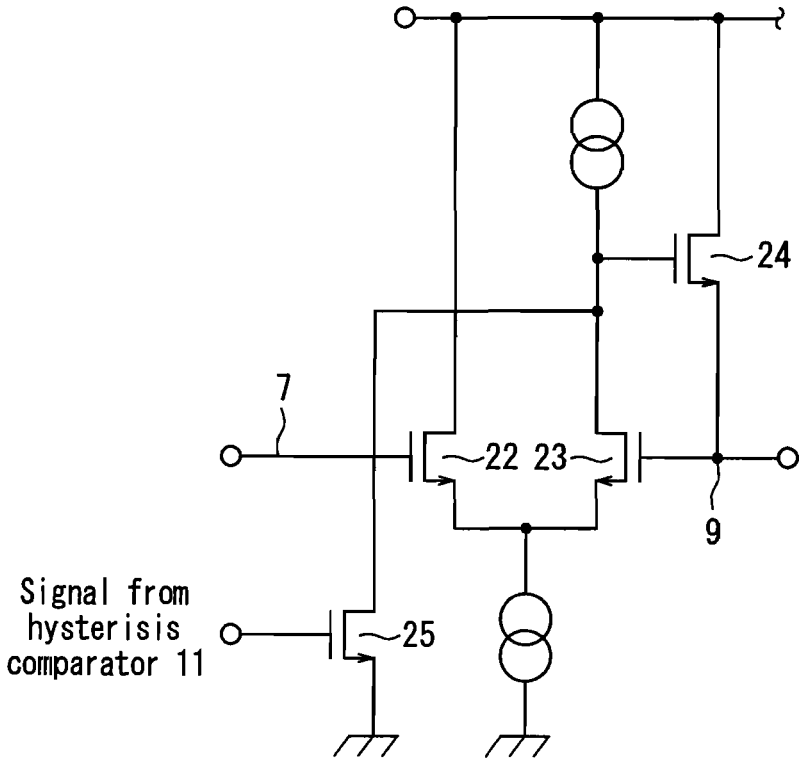
FIG. 6 is a circuit diagram showing a configuration example of a voltage buffer circuit in each of the embodiments of the present invention.
Figure 7:
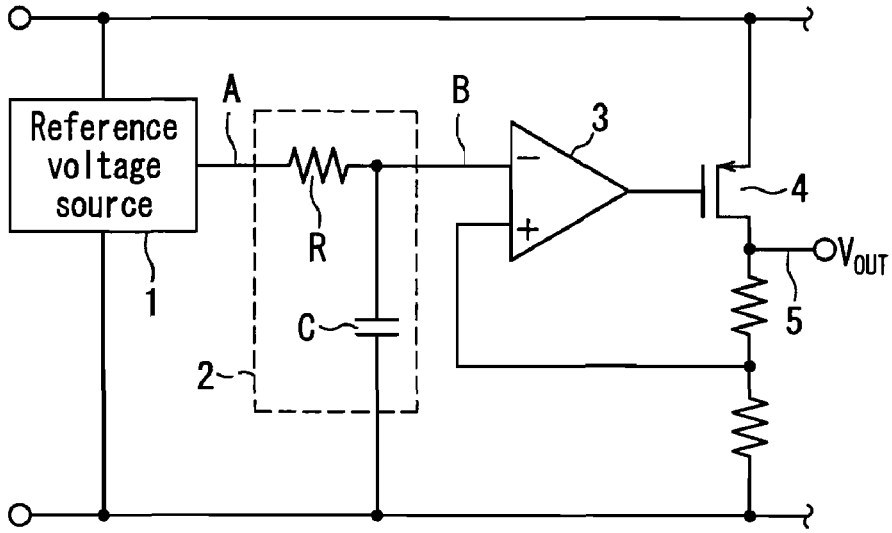
FIG. 7 PRIOR ART
FIG. 7 is a circuit diagram of a reference voltage generator in a first conventional example.
Figure 8:
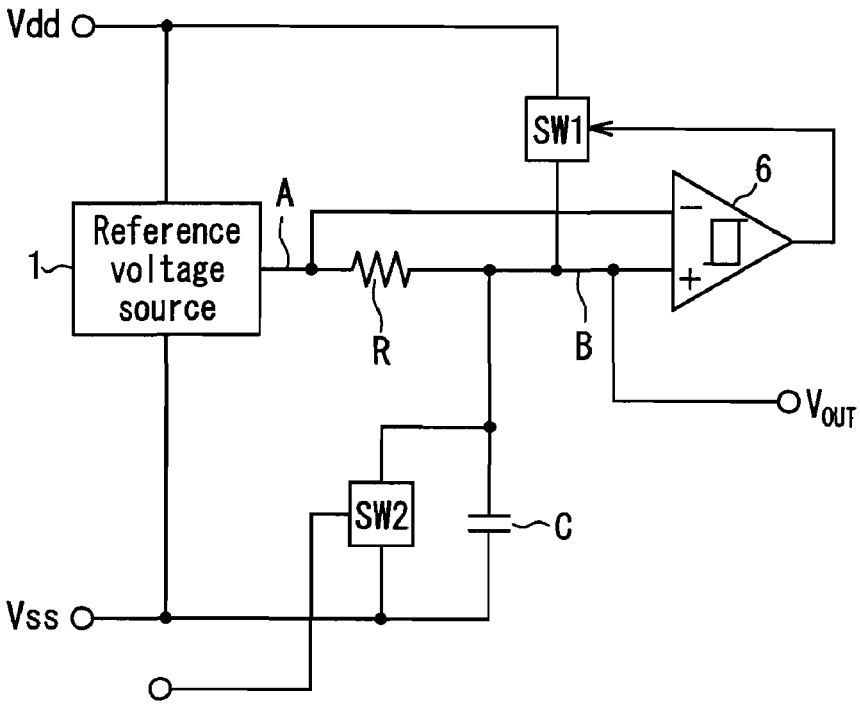
FIG. 8 PRIOR ART
FIG. 8 is a circuit diagram of a reference voltage generator in a second conventional example.

The first voltage buffer circuit 10 in the above-described embodiment can be configured, for example, in the same manner as in a circuit shown in FIG. 6. In this circuit, one of differential input stages composed of transistors 22 and 23 is outputted to an output terminal with a source grounded, and the output terminal is connected directly to a differential negative input terminal so as to feedback negatively, thus constituting an amplifier circuit having a voltage gain of one time. When a gate of a source grounded transistor 24 is made conductive with respect to a ground terminal by means of a MOS switch 25, an output is cut off, i.e. an output impedance is turned to be a high impedance. Further, when the MOS switch 25 is interrupted so that the source grounded transistor operates, the output impedance is turned to be low.

In this embodiment, a current drawing ability is not provided, and therefore, when overshoot of an output voltage is expected to occur, a class AB output stage could be used as an output stage so as to provide the drawing ability.

As described in the foregoing discussion, the present invention allows a reference voltage generator to start-up in a short time and supply a stabilized reference voltage with low noise, and is useful as a reference voltage generator for battery-driven equipment such as a portable communication terminal and the like including a cellular phone.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A reference voltage generator, comprising:

a reference voltage source that generates a direct-current voltage that is used as a reference;

a low-pass filter that is connected to an output node of the reference voltage source;

a first voltage buffer circuit with an input terminal to which the output node of the reference voltage source is connected and an output terminal to which an output node of the low-pass filter is connected, which has a voltage gain of one time; and a hysteresis comparator with one input terminal to which the output node of the reference voltage source is connected and the other input terminal to which the output node of the low-pass filter is connected, wherein at start-up, during a time period in which a voltage difference between an output of the reference voltage source and an output of the low-pass filter exceeds a predetermined value, the first voltage buffer circuit is controlled to be in a low output impedance state based on an output signal of the hysteresis comparator.

2. The reference voltage generator according to claim 1, wherein an output impedance of the first voltage buffer circuit is controlled based on a signal obtained by delaying an output signal of the hysteresis comparator by a constant time period.

3. The reference voltage generator according to claim 1, wherein an output of the low-pass filter is outputted via a second voltage buffer.

4. The reference voltage generator according to claim 2, wherein an output of the low-pass filter is outputted via a second voltage buffer.

5. A reference voltage generator, comprising:

a reference voltage source that generates a direct-current voltage that is used as a reference;

a low-pass filter that is connected to an output node of the reference voltage source;

a voltage buffer circuit that subjects an output of the low-pass filter to impedance conversion to be outputted;

a first switching element that is inserted between an output node of the low-pass filter and an input terminal of the voltage buffer circuit;

a second switching element that is inserted between the output node of the low-pass filter and an output terminal of the voltage buffer circuit;

a third switching element that is inserted between the output node of the reference voltage source and the input terminal of the voltage buffer circuit; and a hysteresis comparator with one input terminal to which an output of the reference voltage source is connected and another input terminal to which an output of the low-pass filter is connected, wherein the first to third switching elements are controlled based on an output signal of the hysteresis comparator so as to be switched between a state where the first switching element is on and the second and third switching elements are off and a state where the first switching element is off and the second and third switching elements are on.

6. The reference voltage generator according to claim 5, wherein at start-up, during a time period in which a voltage difference between an output of the reference voltage source and an output of the low-pass filter exceeds a predetermined value, the first switching element is controlled to be off and the second and third switching elements are controlled to be on.

* * * * *